United States Patent [19]

Russo

[11] 4,010,953

[45] Mar. 8, 1977

[54] CATAPULT BASKETBALL GAME

[76] Inventor: Angelo Russo, 24-25 Kings Highway, Brooklyn, N.Y. 11229

[22] Filed: Aug. 4, 1975

[21] Appl. No.: 601,719

[52] U.S. Cl. ..... 273/85 C; 124/4; 273/105 R

[51] Int. Cl.[2] ..... A63F 7/06; A63F 7/10

[58] Field of Search ..... 273/85 R, 85 A, 85 B, 273/85 C, 85 D, 85 F, 89, 101, 145 A, 105 R; 124/4; 272/54

[56] References Cited

UNITED STATES PATENTS

| | | | |
|---|---|---|---|
| 709,633 | 9/1902 | Haskell | 273/145 A |
| 1,612,699 | 12/1926 | De V. Cole | 273/85 R |
| 2,146,156 | 2/1939 | Nicot et al. | 124/4 |
| 2,225,519 | 12/1940 | Daoda | 273/145 A |
| 2,424,016 | 7/1947 | Botts | 124/4 X |
| 2,611,615 | 9/1952 | Watson et al. | 273/85 R |
| 3,075,764 | 1/1964 | De Lorean | 272/54 |
| 3,208,444 | 9/1965 | Sipos | 124/4 |
| 3,310,308 | 3/1967 | Reagan | 273/85 R X |
| 3,525,320 | 8/1970 | Dekan et al. | 273/89 X |
| 3,544,112 | 12/1970 | Cornblatt | 273/101 |

FOREIGN PATENTS OR APPLICATIONS

| | | | |
|---|---|---|---|
| 19,754 | 10/1899 | United Kingdom | 273/85 R |

*Primary Examiner*—Paul E. Shapiro

[57] ABSTRACT

A catapult basketball includes a backboard having a basket affixed thereon, a rectangularly shaped board member having a court printed thereon, a ball member, a pair of die members for determining the point value of a shot, and a catapult shooting apparatus for propelling a ball member towards the basket.

4 Claims, 3 Drawing Figures

CATAPULT BASKETBALL GAME

BACKGROUND OF THE INVENTION

U.S. Pat. No. 2,720,397 to Blanton teaches a spring loaded plunger means for shotting a ball at a basket.

U.S. Pat. No. 3,074,720 to Carver teaches a mechanical player having movable arms, wherein the player shoots the ball at the basket.

U.S. Pat. No. 3,592,470 to Breslou teaches a cup means with leaf spring for propelling a ball towards a basket. A movable figure is positioned in front of the basket for blocking the ball.

These aforementioned patents are non-applicable to my present invention which teaches an improved catapult means for propelling the ball.

SUMMARY OF THE INVENTION

My present invention relates to a unique and novel catapult basketball game, wherein a player shoots a ball member into a basket by means of a shooting means.

It is an object of my present invention to provide an improved basketball game having an improved catapult shooting means.

It is a further object of my present invention to provide a basketball game that is universally appealing to all age groups and teaches manual dexterity.

A still further object of my invention is to provide a unique means for determining the point valve of a shot made.

Briefly, my present invention comprises a backboard having a basket affixed thereon, a rectangularly shaped board member having a court printed thereon, a ball member, a pair of die members for determining the point valve of a shot, and a catapult shooting apparatus for propelling a ball towards the basket.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
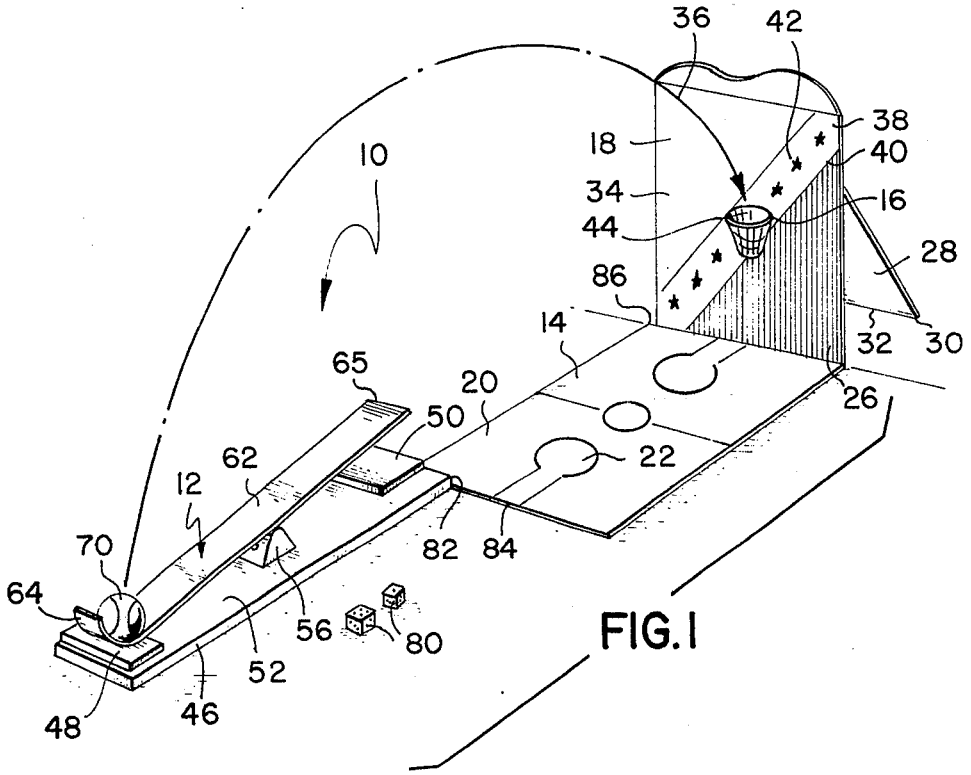
FIG. 1 illustrates a perspective view of a catapult basketball game.

Turning now descriptively to the drawings, in which similar reference characters denote similar elements throughout the several views, FIG. 1 shows a catapult basketball game 10 comprising a shooting means 12, a court 14, and a basket 16 mounted on a backboard 18. The court 14 comprises a planar rectangularly shaped board 20 having a basketball court design 22 on a top surface 24 of the board 20. The backboard 18 comprises a rectangularly shaped member 26 aligned in a vertical plane. A rectangular shaped frame 28 is affixed at an acute angle to a rear surface of member 26, wherein the frame 28 extends downwardly. To the bottom base 30 of frame 28 are affixed a plurality of rubberized foot members 32, wherein members 32 are adapted to engage the floor. The front surface 34 of member 32 has a design printed thereon. The design consists of three sections 36, 38, 40 of red, white and blue, with a plurality of stars 42 printed on the center white section 38. A basket 16 having a net 44 affixed thereon is affixed centrally to the front surface 34 of member 32. The shooting means 12 comprises an elongated rectangularly shaped foot member 46. Rubber pads 48, 50 are affixed onto the upper surface 52 of member 46 at each end thereon. The base 54 of a triangularly shaped member 56 is affixed centrally onto the upper surface 52 of member 46, wherein the triangularly shaped member 56 has a lateral aperture 58 therethrough. Aperture 58 is disposed towards the apex 60 of member 56. An elongated rectangularly shaped ramp member 62 has an upwardly curved end 64 and a square end 65 such that ramp member 62 appears to be J-shaped.

Figure 2:
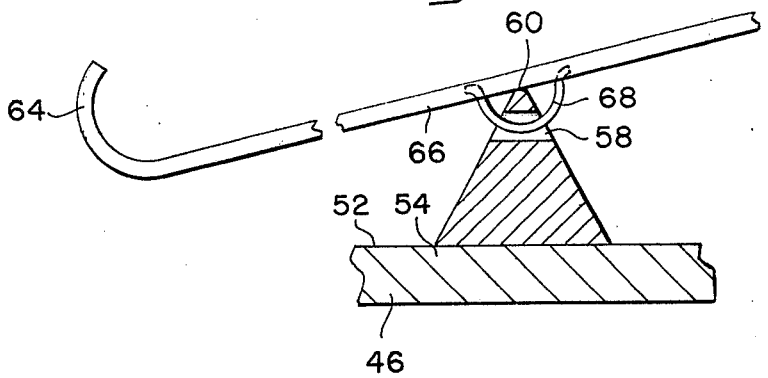
FIG. 2 illustrates a side cross sectional view of a catapult shooting means for the ball of the game.

As shown in FIG. 2, the apex 60 of member 56 pivotally engages the bottom center surface 66 of the ramp member 62. A C-shaped bracket 68 extends through aperture 58, wherein the ends of the bracket 68 are affixed to the bottom surface 66 of the ramp member 62. A ball member 70 rests in the curled end 64 of ramp member 62. When a player pushes downward on the square end 65, the curved end 64 moves upwardly causing the ball member 70 to be propelled forwardly towards the basket 16.

Figure 3:
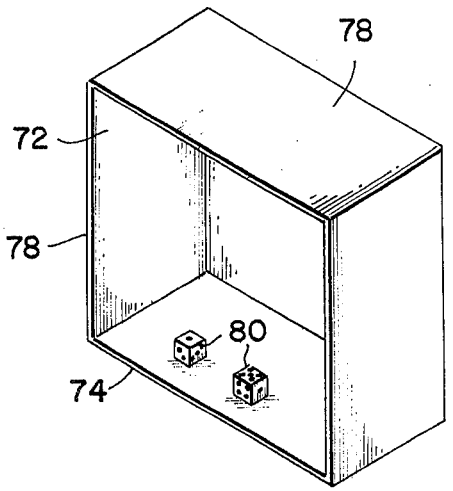
FIG. 3 illustrates a perspective view of a pair of die contained in a shooting box.

FIG. 3 shows a shooting box 72 having a base 74, four upwardly extending walls 76 and an open top 78. The base 74 and walls 76 are made from a see clear through transparent plastic surface as an acrylic. A pair of die 80 are contained in the box 72 whereby the box 72 is saken and the die 80 rolled out of the box 72.

Referring back to FIG. 1, the end 82 of foot member 46 aligned with the square end 65 of ramp member 62 abutts against one end 84 of court 14. The backboard 18 abutts against the other end 86 of the court 14.

The game is played as follows:

One player shakes and rolls the pair of die 80 from the box 72. The player shoots the play member 70 by means of shooting means 12. If the shot is made, the points scored are equal to the sum total of the die 80. If the player rolls doubles, the score is double the total on the die 80. If double ones are rolled, the roll of the die 80 are repeated. If the shot is missed, the play passes onto the next player. If the shot is made, the player shoots again. The play continues to rotate until one player has scored a predetermined number of points.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A catapult basketball game, which comprises:

a. a vertically aligned backboard;

b. a rectangularly shaped frame affixed to a rear surface of said backboard, said frame extending downwardly from said backboard at an acute angle;

c. a plurality of rubberized foot members affixed onto a base of said frame, said rubberized foot members adapted to engage the ground;

d. a basket with net affixed to a front surface of said backboard;

e. a rectangularly shaped member having a basketball court printed on a top surface thereof, one end of said member abutted against said backboard;

f. an elongated, rectangularly shaped foot member, said foot member abutted against another end of said rectangularly shaped member, and extending longitudinally outwardly therefrom;

g. a base of a triangularly shaped member affixed centrally to a top surface of said elongated foot member, said triangularly shaped member having a lateral aperture therethrough, said aperture towards an apex of said triangularly shaped member;

h. an elongated J-shaped ramp member having a curved end, said apex of said triangularly shaped member pivotally engaging a bottom center surface of said ramp member;

i. a C-shaped bracket extending through said lateral aperture, the ends of said C-shaped bracket affixed to said bottom surface of said ramp member;

j. a ball member resting in said curved end of said ramp member, another end of said ramp member adapted to be pushed downwardly by a player causing said curved end to move upwardly to propel said ball forwardly in a curved arc towards said basket; and k. means for determining point valve for said ball member passing through said basket.

2. A game according to claim 1, wherein a rubber pad is affixed onto said top surface of said elongated foot member at each end thereof.

3. A game according to claim 1, wherein said means for determining said point valve includes a pair of die.

4. A game according to claim 3, wherein said means for determining said point valve further includes an open top box, said die contained in said box.

* * * * *